United States Patent [19]

Cordia

[11] Patent Number: 4,861,212

[45] Date of Patent: Aug. 29, 1989

[54] APPARATUS FOR BINDING A PILE OF PAPER

[75] Inventor: Anne-Louise Cordia, Delft, Netherlands

[73] Assignee: Avery International Corporation, Pasadena, Calif.

[21] Appl. No.: 195,477

[22] Filed: May 16, 1988

Related U.S. Application Data

[63] Continuation of Ser. No. 39,578, Apr. 15, 1987, abandoned.

[30] Foreign Application Priority Data

Apr. 18, 1986 [NL] Netherlands ..... 8600986

[51] Int. Cl.[4] ..... B42B 5/04

[52] U.S. Cl. ..... 412/36; 412/902

[58] Field of Search ..... 402/80 R; 412/36, 900, 412/901, 902

[56] References Cited

U.S. PATENT DOCUMENTS 3,223,436 12/1965 Becker ..... 412/36 X
3,518,143 6/1970 Führ ..... 412/902
3,804,694 4/1974 Blair ..... 412/36 X
4,531,873 7/1985 Voges ..... 412/36
4,662,770 5/1987 Block ..... 402/80 R

FOREIGN PATENT DOCUMENTS 2314910 11/1973 Fed. Rep. of Germany ..... 412/36
2528111 4/1977 Fed. Rep. of Germany .

*Primary Examiner*—Paul A. Bell
*Attorney, Agent, or Firm*—Christie, Parker & Hale

[57] ABSTRACT

An apparatus for binding a pile of paper, primarily meant for relatively small-scale use, including the binding by so-called copying-shops, comprising a table for supporting the pile of paper to be bound or glued, and an adhesive tape emitting device comprising a carriage supporting a cassette rotatably housing a roll of adhesive tape. The carriage can be guided by a groove of the table provided beneath a pressure rail for holding down the pile of paper, or by the pressure rail itself. The roll of adhesive tape can be marketed in a filling cassette to be inserted in the cassette.

11 Claims, 4 Drawing Sheets

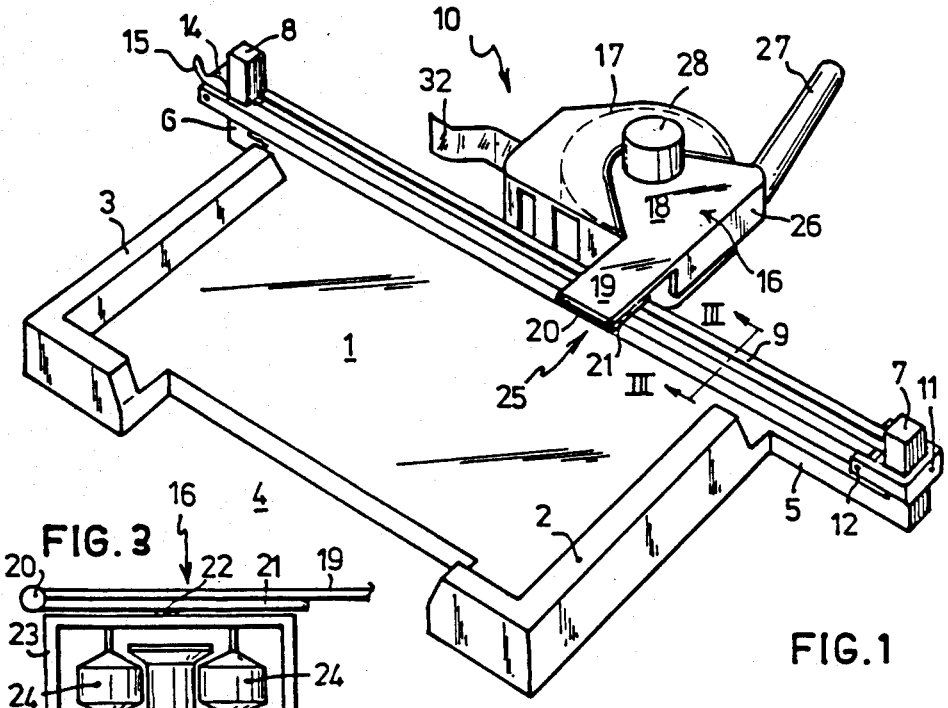
FIG. 1
FIG. 3
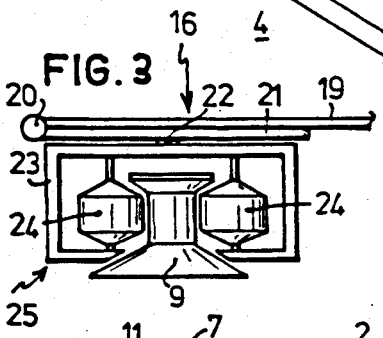
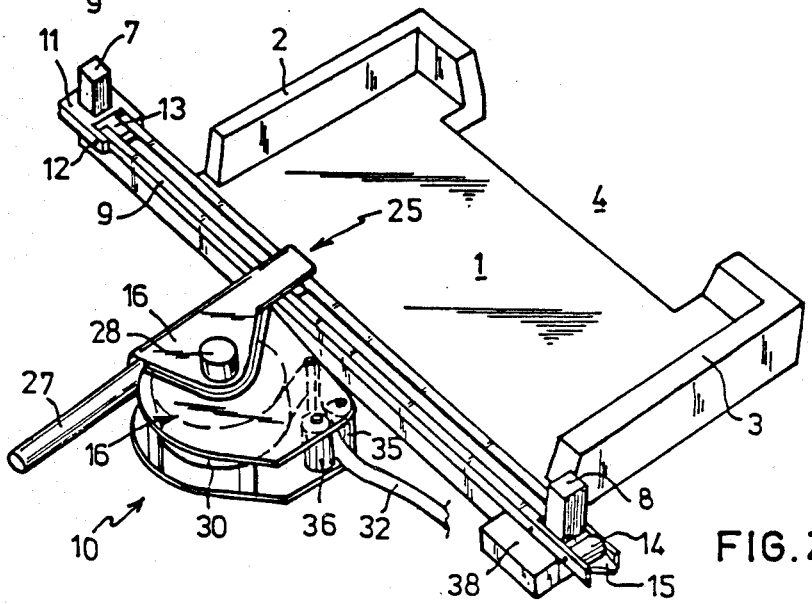
FIG. 2

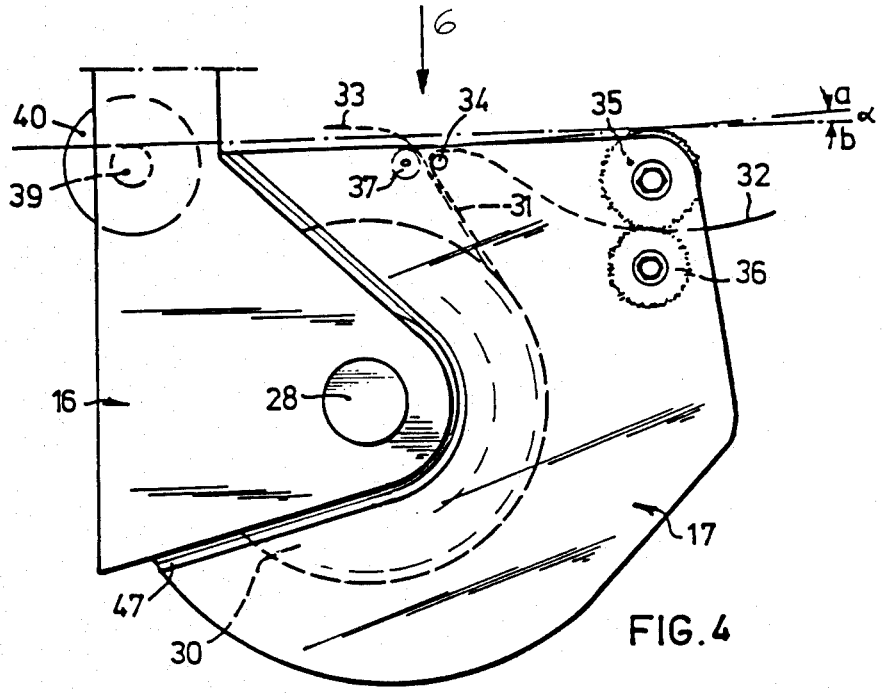
FIG. 4
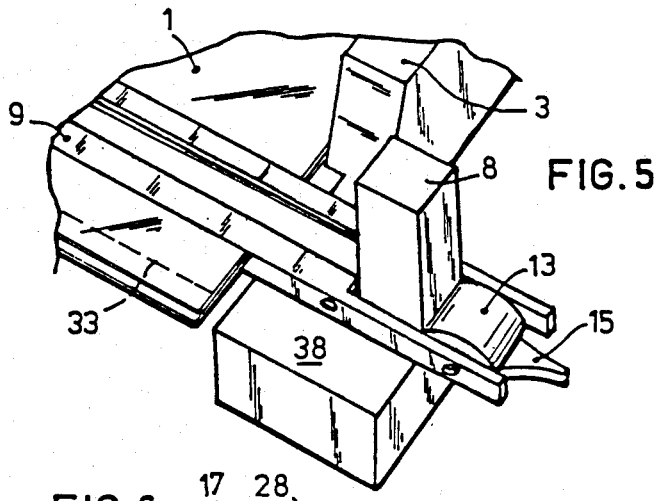
FIG. 5
FIG. 6
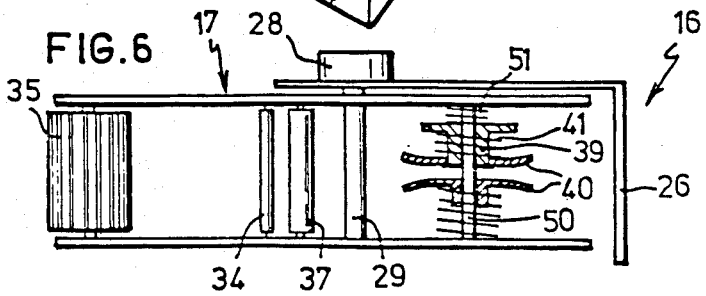

APPARATUS FOR BINDING A PILE OF PAPER

CROSS-REFERENCE TO RELATED APPLICATIONS

This is a continuation of application Ser. No. 07/039,578 filed Apr. 15, 1987 now abandoned.

The invention has reference to an apparatus for binding a pile of paper by folding an adhesive tape around the back of the pile and pressing the tape around it, comprising a table supporting the pile of paper and an adhesive tape emitting device which are movable with respect to one another.

Such a binding apparatus is known from the German Offenlegungsschrift 25 28 111. In this known apparatus the adhesive tape emitting device is mounted stationarily and the pile of paper is moved on a table, constructed in the form of a slide, with respect to the adhesive tape emitting device. This results in a complicated construction that can only be placed on the market at high manufacturing costs and, as a result, is only eligible for relatively large-scale and industrial use.

It is the object of the invention to improve the foregoing. According to the invention an improvement is substantially achieved on account of the fact that the adhesive tape emitting device comprises a support for rotatably supporting a roll of adhesive tape, said support being provided with an arm to enable it to rotate about a substantially vertical axis with respect to a pressure rail and to move parallel to said pressure rail which is able to fix the pile of paper with respect to the table.

A carriage that supports the adhesive tape emitting device can be guided through the pressure rail itselt or through a guiding groove provided beneath the pressure rail at the table.

The support may prefereably rotate about an axis that is horizontal with respect to the pressure rail or the guiding groove. This makes it easier to provide a new adhesive tape.

Figure 9:
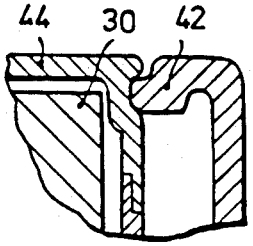
Figure 10:
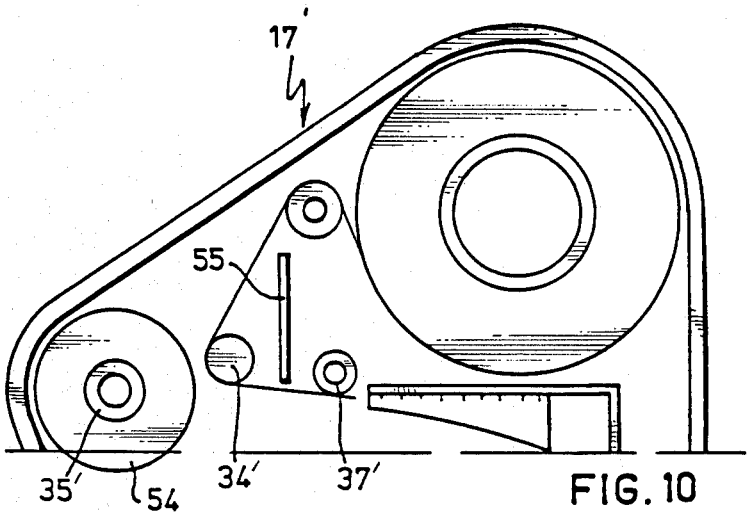
Figure 11:
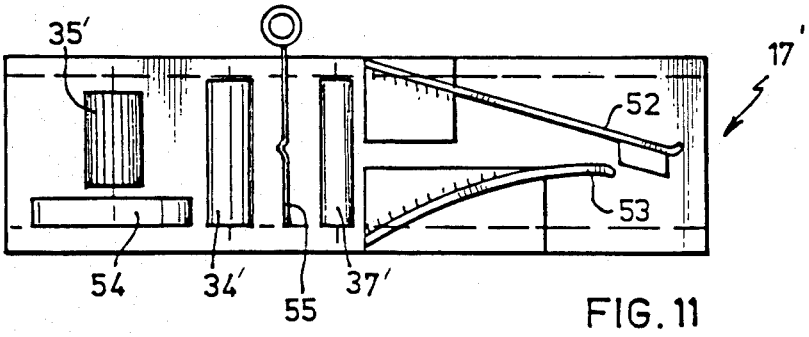

With reference to FIGS. 1 to 11 explained in detail below, if the adhesive tape consists of a covering strip 32 with a silicone layer and a support covered with glue 33 at the side facing the covering strip, then the adhesive tape is loctated in a cassette 17 that can be non-rotatably connected to the support 16 constructed as cassette support, said cassette, at the side that is to be pressed against the back of the pile of paper, is preferably provided with an emitting rod 34, a first pressure roller 37 and with a discharge roller having a counter-roller 36 which are juxtaposed substantially perpendicularly to the direction of travel of the cassette 17 and between which only the covering strip 32 passes, while a pressing mechanism shown in FIG. 11 and described herein below is provided to fold the carrier 33 around the back of the pile of paper and to press against the pile of paper to be bound.

The pressure rail extends beyond the ends of the table to such an extent that the first pressure roller 37 may reach the beginning of the back that is to be glued, switch extension back relative to the pile of paper that is to be glued, so that the first pressure roller may reach the end of the back that is to be glued, while the discharge roller 35 may then still be rotated.

It is an exceptional characteristic of the pending invention that the discharge roller has a rough surface so that the back may also be roughened, said discharge roller being drivable by a wheel running over the guiding groove. As a result the binding results are improved.

The pressing mechanism may comprise a pair of resilient lips that are attached to the cassette.

A cassette that is meant to be used for the binding apparatus according to the invention comprises, as its most essential characteristic, a trough-shaped housing in which a filling cassette fits that is provided with a core with a roll of adhesive tape, which filling cassette can be fixed into said housing by means of a snap-fit as shown in FIG. 9 and a back adapted to the outward appearance of the cassette support, the bottom of the housing being provided with at least one hole to be able to remove the filling cassette from said housing.

In a filling cassette, meant to be used for an apparatus and a cassette according to the invention, the glue-covered carrier of the adhesive tape may be pre-cut to match the length of the back that is to be glued.

Figure 8:
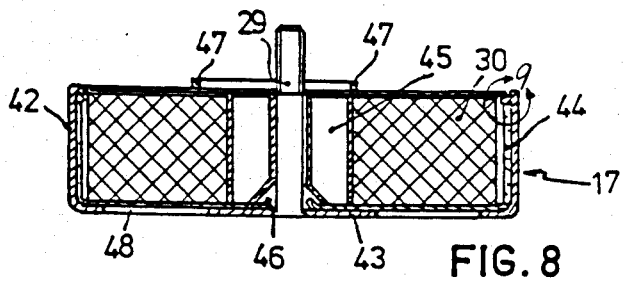
Figure 7:
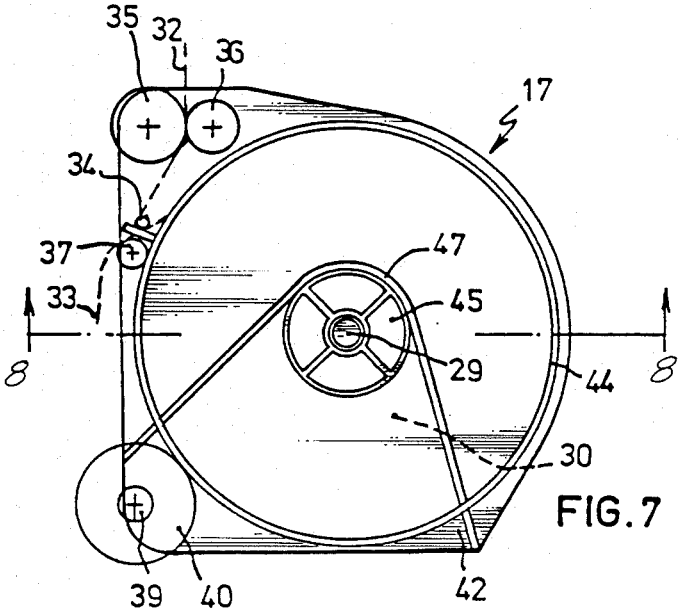

The invention will further be illustrated on the basis of the drawing, in which, by way of example, an embodiment of a binding apparatus according to the invention is represented. In the drawings:

FIG. 1, in perspective, shows the whole apparatus for binding a pile of paper, FIG. 2, in perspective, shows the apparatus of FIG. 1 seen from the side of the adhesive tape emitting device, FIG. 3 shows a schematic top view of the cassette support and the set of rollers in the direction of the line III—III of FIG. 1, FIG. 4 shows a schematic top view of a portion of the adhesive tape emitting device, FIG. 5, in perspective, shows a detail of the corner of the table with the eccentric roll for securing the pressure rail, FIG. 6 shows a diagram of the pressing mechanism viewed in the direction of the arrow VI of FIG. 4, FIG. 7 shows a top view of a cassette to be used for the apparatus of FIGS. 1–3, FIG. 8 shows a section according to line VIII—VIII of the cassette of FIG. 7, FIG. 9, to a larger scale, shows the top righthand corner of the section of FIG. 8, and FIGS. 10 and 11 show a top and front view, respectively, of another embodiment of a cassette.

The apparatus depicted in the drawing substantially comprises a table 1 with a front and a rear edge 2 and 3, respectively, a recess 4 in one of the longitudinal edges and al ong leg 5 as well as a short leg 6 at the other longitudinal edge. On the long leg 5 an adjusting post 7 is provided and on the short leg a clamping post 8. The posts 7 and 8 are meant to cooperate with a pressure rail 9 over which an adhesive tape emitting device 10 can move.

The edges 2 and 3 extend along the cross edges and one of the longitudinal edges of the table 1 till the recess 4 in such a way that a suitable depositing surface is provided for the pile of papers that is to be bound, and said pile can also easily be removed from it after binding. Of course one is at liberty to bind a pile of paper having a format that differs from that of the depositing surface or to place a pile of paper having the format of the depositing surface diagonally on the table, in other words through an angle of 90° with respect to the most pertinent position. The inner walls of the edges 2, 3 may be provided with indications as to the height of the pile that has to be bound and these indications should correspond with the height adjustment of the pressure rail 9 with respect to the adjusting post 7 in order to attain good binding results.

Around the adjusting post 7 a fork 11 is provided which has a width that is adapted to the cross section of the adjusing post 7 in such a way that it can slide over the post when it is turned up around a horizontal axis 12 that extends through one of the outer ends of the pressure rail 9.

In the horizontal position a plug 13, provided at one of the ends of the pressure rail 9, presses against the adjusting post 7 so that the pressure rail 9 can then not slide over the adjusting post. The plug 13 may be made of synthetic material.

The opposed of the pressure rail 9 has a provision for rotatably accommodating an eccentric roll 14 with a handle 15 with the aid of which the pressure rail 9 to provide a snap-fit can be anchored to the clamping post 8 after the pile of paper that has to be bound has been pressed against the table 1 by the pressure rail 9.

The posts 7 and 8 are illustrated with a square cross section here, but they may also have another polygonal cross section.

The base of the table 1 and the position of the pressure rail 9 have now been selected in such a way that the areas adjacent to the back of the pile of paper that has to be bound are free to receive the edges of adhesive tape that is yet to be discussed, said edges being folded around said areas.

The adhesive tape emitting device 10 comprises a plate-shaped cassette support 16 to which, at the bottom side, a cassette 17 can be attached, and which is movably mounted on the pressure rail 9. In FIG. 1 it is seen that the cassette support 16 comprises a substantially triangular portion 18 that lies above the cassette 17, and an oblong portion 19 that lies above the pressure rail 9. The oblong portion is connected to a sheet 21 (FIG. 3) via a horizontal pivot 20, which plate is, itself, connected around a vertical pin 22 to a carriage 23 that contains a plurality of, preferably three wheels 24 that can travel over the pressure rail 9 with a substantially I-shaped cross section. This I-profile is constructed more heavily at the bottom side than at the upper side. Elements 21, 22, 23 and 24 is indicated as unit 25 in FIGS. 2 and 3.

Adjacent to the triangular portion 18 the cassette support 16 has a bent-over edge 26 which can serve as a guide when the cassette 17 is put in position and is also connected to an arm 27 to enable the cassette support to be operated. The parts 16, 18–20, 26 and 27 may be in a single piece. In the vertical central axis of the cassette 17 there is a pin 29 (FIG. 6) provided with a knob 28, which pin extends through a hole in the cassette support 16 in a manner that is yet to be elucidated. By removing the knob 28 the cassette 17 may be released from the cassette support 16. With the aid of the arm 27 that is attached to the cassette support 16 the cassette 17 may be pressed against the back of the pile of paper and moved along it.

In FIG. 4 a roll 30 with adhesive tape 31 is visible in the cassette 17 around the (non-visible) pin with knob 28. The adhesive tape consists of a covering strip 32 with a silicone layer and a carrier 33 that is covered with glue at the side facing the covering strip 32 or is made adhesive in some other way. The carrier 33 is usually called "tape".

The covering strip 32 extends around an emitting rod 34 to the nip of a discharge roller 35 and a reaction-roller 36.

The carrier 33 projects between the emitting rod 34 and a first pressure roller 37 outwards, out of the cassette 17 and, with its adhesive side, it reaches the back of the pile of paper that is to be bound when the adhesive tape emitting device 10 is pressed against it with the aid of the arm 27 (FIG. 1). With the same arm the adhesive tape emitting device is then moved from left to right in FIG. 2. The discharge roller is rotated on account of the fact that the adhesive tape emitting device is moved along the back of the pile of paper and when this takes place the covering strip 32 is discharged. The discharge roller 35 also serves to roughen the back, which will result in a better adhesion of the carrier 33 to the back.

In FIG. 4 it is seen that the tangent a to the first pressure roller 37 and the discharge roller 35 includes an acute angle $\alpha$ with the tangent b to a pressure roller 39, which is yet to be discussed, and the discharge roller 35.

In FIG. 5 a detail is illustrated of the corner of table 1 at the location of the rear edge 3 and the short leg 6 with clamping post 8 and with the eccentric roll 14 cooperating with it. From this figure it appears that a projection 38 is provided next to the short leg 5, said projection lying in the extension of the back that is to be bound, for the discharge roller 35 must keep on rotating until the discharge rod 34 has reached the end of the back. In this figure a dotted line indicates the position in which the carrier 33 is finally folded around the back of the pile of paper that is to be bound.

FIG. 6 shows the principle of folding the carrier 33 around the back and pressing against it. Parts that have already been discussed are the cassette support 16, the cassette 17, the knob 28 with pin 29, as well as the emitting rod 34, the discharge roller 35 and the first pressure roller 37. On a shaft 30 a second pressure roller 39 and a pair of washers 40 are mounted that are pressed together by means of springs 41. The washers 40 are preferably made of a resilient material, and the spring constant of the springs 41 is attuned to the material characteristics of the washers 40 and the thickness of the piles of paper that are to be bound, in such a way that the carrier 33 is always folded neatly around the back and pressed against it, irrespective of the number of sheets of paper of the pile that is to be bound, at least within the limits indicated below for various widths of adhesive tape.

| Width of adhesive tape (cm) | Thickness of the pile of paper (mm) minimum | maximum |
|---|---|---|
| 2½ | 1 | 5 |
| 3½ | 5 | 15 |
| 5 | 15 | 30 |

The upper washer 40 has a bore that is adapted to the diameter of the second pressure roller 39. The second pressure roller 39 is biassed by a pressure spring 51 that is stronger than the springs 41 and ensures that the upper washer 40 always stands below the pressure rail in more or less the same position, for the height position of the cassette support of the adhesive tape emitting device is constant for all widths of adhesive tape.

The bottom washer 40 has a bore that is adapted to the diameter of the shaft 50.

The adhesive tapes preferably consist of a covering strip on which successively precut carriers of a length of 29.7 mm, for instance, are placed, so that sheets of paper of the standard format A4 may be handled by the invented apparatus. Other dimensions are possible too, however.

The invented apparatus and the corresponding cassettes are especially meant for use on a relatively small scale, including the binding of reports by co-called copying-shops, for instance. In the event of large-scale use variants of the apparatus are conceivable, with automatic devices for the carriers and adjustable edges 2, 3.

In the FIGS. 7–9 further details are given of the cassette 17 for smale-scale use. This cassette appears to be built-up of a trough-shaped housing 42 with a housing bottom 43 from which the pin 29 protrudes that, at its upper end, is provided with helical thread to cooperate with the knob 28 (FIGS. 1, 2, 4 and 6). A circular filling cassette 44 fits into the trough-shaped housing 42, said filling cassette being provided with a hollow core 45 that can be slid around the pin 29 and around which the roll 30 of adhesive tape is wound. In so far as the circumference of the trough-shaped housing deviates from the circumference of the filling cassette, the housing has horizontal upper surface portions containing the upper pivots for the rolls 35–37 and 39.

At the end facing the bottom of the housing, the bore of the core 45 is conically widened and there it can cooperate with lips 46, protruding obliquely from the bottom 43 of the housing, said lips ensuring that the roll 30 does not slide away when it is half-empty and the filling cassette 44 is separated from the cassette 17, for then the pin no longer projects into the bore of the core 45. At the upper surface the cassette 17 and the filling cassette 44 have a ridge 47, the course of which matches the outward appearance of the cassette support 16 and therefore serves to prevent rotation of the cassette with respect to the cassette support.

At the circumferential surface near the upper surface the filling cassette 44 has a groove which can cooperate with a edge—directed inwards—of the housing 42, in the manner depicted in FIG. 9. The filling cassette consists of an upper- and a lower half which can be attached to one another after the cassette has been filled with the roll 30 as illustrated in FIG. 9.

The bottom 43 of the housing is provided with a plurality of holes 48 with dimensions that are large enough to allow fingers to pass, so that an empty filling cassette 44 may be pressed out of the housing 42. Of course the knob 28 must first have been removed. After a new filling cassette 44 has been placed, the adhesive tape 31 projecting from it is divided into a covering strip 32, which is placed around the emitting rod 34 and between the rollers 35 and 36 of the cassette 17, and a carrier 33 that, via a groove (not shown) in the upper surface of the housing 42, is led around the first guiding roller 37 of the cassette, ready to bind a pile of paper.

Before binding is begun, the adhesive tape emitting device is moved so far in the direction of the adjusting post 7 that the carrier 33 is located at the beginning of the back of the pile of paper that is to be bound. With the arm 27 the discharge roller 35 and the first pressure roller 37 of the adhesive tape emitting device are pressed against the back and said device is then moved in the direction of the clamping post 8 along the back. At a certain moment the second pressure roller takes over the task of the first pressure roller 37 and tilts the adhesive tape emitting device over through angle $\alpha$, as illustrated in FIG. 4. After the first pressure roller 33 has reached the end of the pile of paper that is to be bound, the carrier 33 may be cut (if it is not precut) and the last piece of the provided carrier may be folded by the washer 40, after which the adhesive tape emitting device may be turned away from the back.

It is possible to replace the entire filling cassette 44 when the roll 30 is empty, or to replace the cassette 17 when wear-sensitive parts necessitate its replacement, for instance when the discharge roller 35 is no longer rough enough.

In FIGS. 10 and 11 a cassette 17' is illustrated for an adhesive tape that consists of a carrier of paper impregnated with latex, said carrier being covered with glue at it bottom side and being provided with a silicone layer at the upper side. The pressing mechanism here consists of two resilient lips 52 and 53, the upper lip 52 of which can deflect over a larger distance. In this embodiment the discharge roller 35' is driven by a wheel 54 that runs over a guiding groove (not illustrated). Furthermore, a sliding blade 55 is present in this embodiment, to be able to cut the adhesive tape.

On account of the fact that the cassettes and filling cassettes for the various widths of the adhesive tape 31 are separately obtainable, an independent protection is requested for those parts in the claims.

Other embodiments than the ones depicted in the drawing and/or discussed on the basis of the drawing, fall within the scope of the claims as well.

I claim:

1. An apparatus for binding a pile of paper which comprises:

(a) a table for supporting a pile of paper providing a back for binding, (b) a pressure rail adapted to fix the pile of paper on the table with the back of the pile of paper parallel thereto, said pressure rail being movable away from the table to adjust to the thickness of the pile of paper, (c) an adhesive tape emitting means comprising support means including an arm and means to hold in rotatable relation to the arm a roll of adhesive tape, said adhesive tape having an adhesive surface and means to permit rotation of the support means about an axis normal to the pressure rail to engage said adhesive surface of the tape with the back of the pile of paper, said adhesive tape emitting means being movable parallel with respect to the pressure rail and in movement relative to the pressure rail and against the pile of paper causing pressing of the adhesive tape against the back of the pile of paper as the adhesive tape is emitted from the roll, said means including means to fold a portion of the adhesive tape around a portion of each said of the pile of paper.

2. Apparatus as claimed in claim 1 in which the support means is upwardly rotatable relative to the pressure rail.

3. Apparatus as claimed in claim 1 in which the table is provided with a guiding groove parallel to the pressure rail and the tape emitting means includes roller means to engage the groove and guide the tape emitting means parallel to the pressure rail.

4. Apparatus as claimed in claim 3 in which the arm means is upwardly rotatable relative to the pressure rail to move the roller means to engage the groove away from the groove.

5. Apparatus as claimed in claim 3 in which the adhesive tape emitting means comprises a cassette detachably secured to the arm and containing a roll of adhesive tape, means to engage the adhesive surface of the tape with the back of the pile of paper, roller means to guide the tape emitting means along the groove contained in the table and means to fold the applied tape around the back of the pile of paper and in which the pressure rail extends beyond the table to enable engagement and folding of the adhesive tape around the entire back of the pile of paper, held on the table by the pressure rail.

6. Apparatus as claimed in claim 5 in which the roll of adhesive tape has a silicone layer covering strip over the adhesive, said strip being fed between a pair of rollers, one of said rollers being driven by the roller means, said rollers cooperating to draw the covering strip away from the adhesive by rotation of the roller means in the groove during movement of the tape emitting means across the pile of paper.

7. Apparatus as claimed in claim 5 in which one of said roller means is rough and adapted to contact and roughen the back of the pile of paper to which the adhesive is to be applied.

8. Apparatus as claimed in claim 1 in which the pressure rail is of substantially I-shaped construction wider at the bottom than at the top and is engaged between the top and bottom by a plurality of rollers contained in a carriage connected in pivotal relation to the arm.

9. Apparatus as claimed in claim 1 in which adhesive tape emitting means comprises a cassette detachably secured to the arm and containing the roll of adhesive tape, said cassette additionally containing a first pressure roller to engage the adhesive surface of the tape with the pile of paper and pressure means to fold the engaged tape around the back of the pile of paper and in which the pressure rail is of a length sufficient to extend beyond the table to enable engagement of and folding of the adhesive tape around the entire back of the pile of paper held on the table by the pressure rail.

10. Apparatus as claimed in claim 9 in which the roll of adhesive tape has a silicone layer covering strip; over the adhesive, said strip being fed between a second and third pressure rollers which cooperate to draw the strip away from the adhesive tape when the adhesive tape is applied to the back of pile of paper by contact of the second roller with the back of the pile of paper.

11. Apparatus as claimed in claim 10 in which the second pressure roller has a rough surface adapted to roughen the back of the pile of paper to which the adhesive is to be applied.

* * * * *

UNITED STATES PATENT AND TRADEMARK OFFICE

CERTIFICATE OF CORRECTION

PATENT NO. : 4,861,212

DATED : August 29, 1989

INVENTOR(S) : Anne-Louise Cordia

It is certified that error appears in the above-identified patent and that said Letters Patent is hereby corrected as shown below:

In the Specification:

Column 1, line 34, change "itselt" to -- itself --.
Column 1, line 37, change "prefereably" to -- preferably --.
Column 1, line 46, change "loctated" to -- located --.
Column 1, line 51, after "roller" insert "35".

Column 2, line 17, change "pre-cut" to -- precut --.
Column 2, line 42, change "righthand" to -- right-hand --.
Column 2, line 49, change "al ong" to -- along --.
Column 2, line 56, change "till" to -- to --.

Column 3, line 43, change "is" to -- are --.

Column 4, line 14, change "a" and "b" to -- a -- and -- b --.
Col. 4, line 16, change "b" to --b--
Column 5, line 6, change "co-called" to -- so-called --.
Column 5, line 11, change "smale" to -- small --.
Column 5, line 19, change "In so far" to -- Insofar --.
Column 5, line 38, before "edge" insert -- clicking --.

Column 6, line 12, befoore "bottom" change "it" to -- its --.

UNITED STATES PATENT AND TRADEMARK OFFICE

CERTIFICATE OF CORRECTION

PATENT NO. : 4,861,212

DATED : August 29, 1989

INVENTOR(S) : Anne-Louise Cordia

It is certified that error appears in the above-identified patent and that said Letters Patent is hereby corrected as shown below:

In the Claims

Column 6, line 51, after "said" delete "of the".

Column 8, line 19, before "pile" insert -- the --.

Signed and Sealed this

Eighteenth Day of December, 1990

*Attest:*

HARRY F. MANBECK, JR.

*Attesting Officer*

*Commissioner of Patents and Trademarks*